US005738594A

United States Patent [19]

Kinney

[11] Patent Number: 5,738,594

[45] Date of Patent: Apr. 14, 1998

[54] GOLF GAME

[76] Inventor: Dale Kinney, 575 ET Richardson Rd., Nakina, N.C. 28455

[21] Appl. No.: 735,803

[22] Filed: Jan. 21, 1996

[51] Int. Cl.[6] ..... A63B 67/02

[52] U.S. Cl. ..... 473/171; 473/162

[58] Field of Search ..... 473/162, 159, 473/169, 158, 171

[56] References Cited

U.S. PATENT DOCUMENTS

| | | | |
|---|---|---|---|
| D. 267,417 | 12/1982 | Newton | D21/11 |
| D. 347,661 | 6/1994 | Dickson | D21/11 |
| 3,584,877 | 6/1971 | Florian | 473/159 |
| 3,797,833 | 3/1974 | Nokusek | 273/178 R |
| 3,837,653 | 9/1974 | Fox et al. | 273/178 R |
| 4,572,512 | 2/1986 | Tegart | 473/169 |
| 4,743,026 | 5/1988 | Eady | 473/162 |
| 4,934,704 | 6/1990 | Mazer | 473/158 |
| 5,026,060 | 6/1991 | Beeber | 273/176 F |

*Primary Examiner*—Mark S. Graham
*Attorney, Agent, or Firm*—David L. Volk

[57] ABSTRACT

A mat includes a top surface marked thereon dividing the top surface into a plurality of scoring areas. The scoring areas each have a scoring number marked therein. A boundary line is marked on the top surface of the mat dividing the top surface into two scoring zones, each of the scoring zones having a plurality of the scoring areas therein. Players use a golf club to attempt to hit a ball into the scoring zone across the boundary line from the player.

1 Claim, 1 Drawing Sheet

GOLF GAME

BACKGROUND OF THE INVENTION

1. Field of the Invention

The present invention relates to games, specifically to a golf game which can be played indoors and outdoors.

2. Description of the Related Art

Golf is one of America's most popular games. The game of golf and its variations can be played on a full size 18 hole golf course, a smaller "chip and putt" type golf course, or a miniature golf course. In most cases, golf is played out of doors.

What is needed is a golf game which can be played indoors or outdoors, is easy to store, transport, and set up for play, and can be enjoyed by amateurs and professional players of all ages.

SUMMARY OF THE INVENTION

The golf game of the present invention includes a mat having a top surface marked thereon dividing the top surface into a plurality of scoring areas. The scoring areas each have a scoring number marked therein. A boundary line is marked on the top surface of the mat dividing the top surface into two scoring zones, each of the scoring zones having a plurality of the scoring areas therein. Players use a golf club to attempt to hit a ball into the scoring zone which is positioned across the boundary line from the player.

Accordingly, several objects and advantages of the present invention are:

a. to provide a golf game which can be played indoors or outdoors;

b. to provide a golf game which is easy to store;

c. to provide a golf game which is easy to transport;

d. to provide a golf game which is easy to set up for play; and e. to provide a golf game which can be enjoyed by amateurs and professional players of all ages.

Still further objects and advantages will become apparent from the ensuing description and drawings.

DETAILED DESCRIPTION

1. Description of the Apparatus

Figure 1:
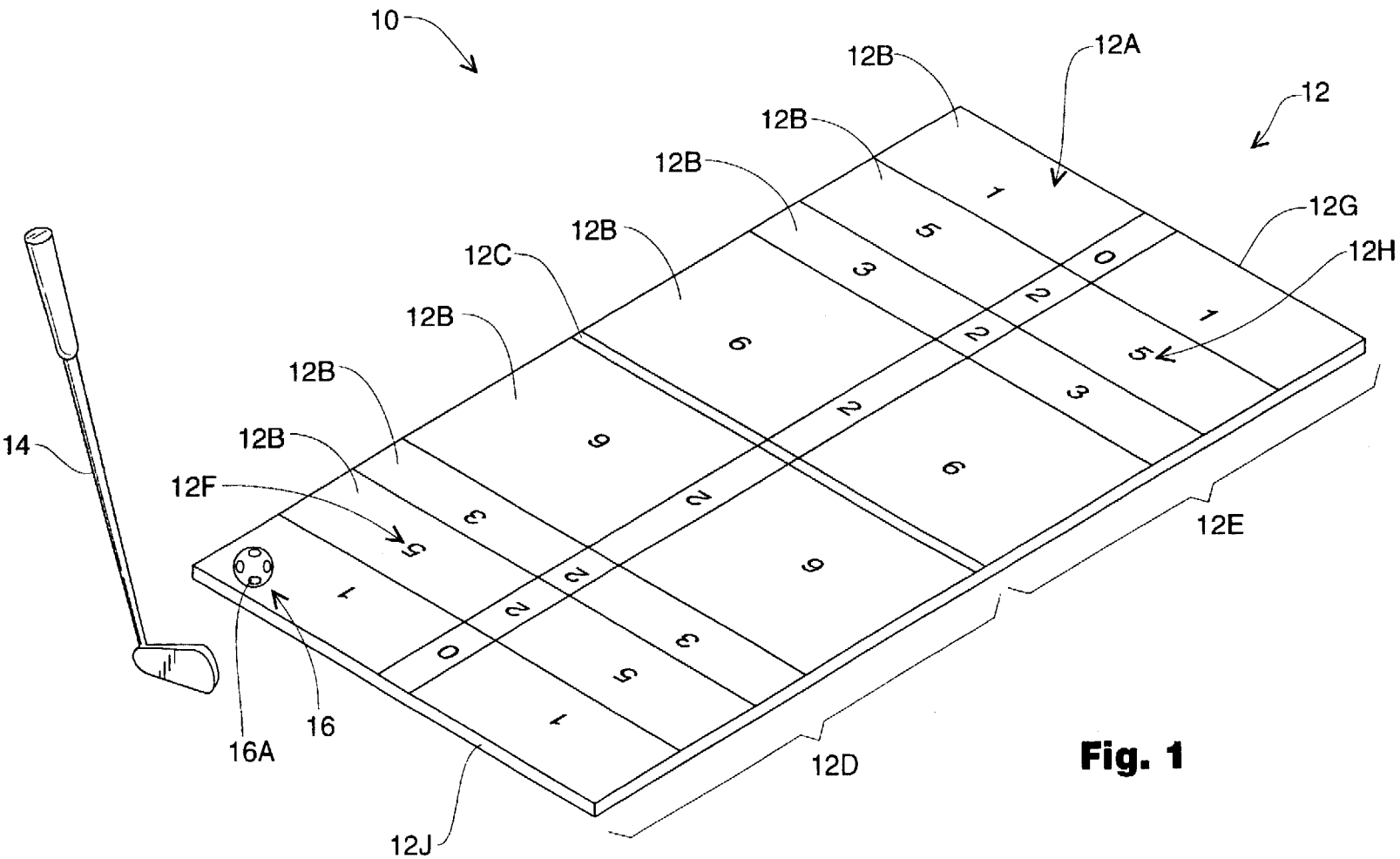
FIG. 1 is a perspective view of the golf game.

FIG. 1 is a perspective view of a golf game apparatus 10, including a mat 12, a club 14 and a ball 16. The club 14 and the ball 16 may be a conventional club and ball as used for conventional golf or miniature golf. Alternatively, the club 14 and the ball 16 may each be made of plastic for lightness and safety. The ball 16 may include perforations 16A there-through to lighten the ball 16 even further. It is within the scope of the present invention that the club 14 and the ball 16 may be made of other materials such as wood, robber, sponge material and the like.

The mat 12 is preferably an indoor-outdoor carpet, so that the golf game 10 may be played indoors or outdoors, and may be easily rolled, unrolled and transported. Other materials are possible, such as robber, vinyl, plastic, wood and the like.

A top surface 12A of the mat 12 is marked thereon to divide the top surface 12A into a plurality of scoring areas 12B. The mat 12 is rectangular; however, other shapes are possible, such as square, circular, and the like.

A boundary line 12C separates the mat into a first scoring zone 12D and a second scoring zone 12E. The scoring areas 12B within the first scoring zone 12D each have a first scoring number 12F marked therein which appears upright when viewed from a second end 12G of the mat 12. The scoring areas 12B within the second scoring zone 12E each have a second scoring number 12H marked therein which appears upright when viewed from a first end 12J of the mat 12.

As shown in FIG. 1, the boundary line 12C divides the mat 12 into two evenly sized scoring zones 12D, 12E, and the scoring areas 12B within each of the scoring zones 12D, 12E are sized and arranged the same relative to the boundary line 12C; however, many variations are possible that are within the scope of the present invention. For example:

a. the first scoring zone 12D may be a different size than the second scoring zone 12E;

b. the first scoring zone 12D may be differently shaped than the second scoring zone 12E;

c. the first scoring zone 12D could be divided into a different number of scoring areas 12B of different sizes, different shapes, and a different arrangement than the second scoring zone 12E; and d. the mat may be divided into more than one scoring zone.

Another modification would be to add graphics which resemble a conventional or miniature golf course to the top surface 12A of the mat 12.

2. Method of Playing

Players take turns. Oh his or her turn, the player (not shown) stands near the first end 12J of the mat 12, and places his or her ball 16 on the scoring area 12B marked with the first scoring number 12F equal to zero. The player then hits the ball 16 with the club 14. The score which the player takes for his or her turn is based on where the ball 16 lands at the end of the turn. If the player is not satisfied with the score based on where the ball 16 lands after one stroke, the player may take a second stroke from where the ball 16 landed after the first stroke. No more than 2 strokes are permitted per turn.

If the ball 16 comes to rest in the second scoring zone 12E, the player takes the second scoring number 12H within the scoring area 12B on which the ball 16 is resting as his or her score. If the ball 16 comes to rest in the first scoring zone 12D or off of the mat 12, the player takes a seven as his or her score.

Whenever players begin their turn from the second end 12G of the mat instead of the first end 12J as described above, the ball 16 must come to rest in the first scoring zone 12D to take the first scoring number 12F within the scoring area 12B on which the ball 16 is resting as his or her score. If the ball 16 comes to rest in the second scoring zone 12E or off of the mat 12, the player takes a seven as his or her score.

Play ends when each player has taken a pre-determined number of turns, the player with the lowest score being the winner.

Many variations of game play are possible. For example, the players may group into two or more teams. Some of the players may always play from the first end 12J of the mat 12, while the other players always play from the second end 12G. This could be a way of handicapping a better player or team, by having them always play toward a more difficult scoring zone 12D, 12E. Players could switch the end 12G, 12J of the mat 12 from which they begin their turn according to any pre-determined system. Players may decide before the game that they must leave their ball 16 on the mat 12 until all players have taken their turn, allowing the balls 16 to be moved by balls 16 hit by other players. Alternatively, each player may be required to pick up their ball 16 at the end of a turn. A fun modification would be to allow a player to leave their ball 16 on the mat 12 at the end of their turn if the player is dissatisfied with his or her score on that turn and hopes that the ball 16 will be moved by another player's ball 16.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. The scope of the invention is to be limited only by the following claims and their legal equivalents.

The invention claimed is:

1. A golf game apparatus including a mat for use with a club and a ball, a boundary line marked on a top surface of the mat dividing the top surface into a first scoring zone and a second scoring zone, each of the first and second scoring zones having a plurality of rows and columns of scoring areas therein, the rows being parallel to the boundary line and the columns being perpendicular to the boundary line, each of the scoring areas having a scoring number therein, wherein each of the scoring numbers in the first scoring zone appears upright when viewed from a position across the boundary line from the first scoring zone, and each of the scoring numbers in the second scoring zone appears upright when viewed from a position across the boundary line from the second scoring zone, and wherein in each column, the scoring number in the scoring area furthest from the boundary line is lower than the scoring number in the scoring area closest to the boundary line, and wherein in each row, the scoring number in the scoring area most central with respect to the mat is lower than the scoring numbers least central with respect to the mat.

* * * * *